US007536955B2

(12) United States Patent
Bernard et al.

(10) Patent No.: US 7,536,955 B2
(45) Date of Patent: May 26, 2009

(54) METHOD AND DEVICE FOR INFLUENCING THE FAN-OUT EFFECT

(75) Inventors: Andreas Ewald Heinrich Bernard, Sulzfeld (DE); Peter Krokolinski, Würzburg (DE); Kurt Johannes Weschenfelder, Zell/Main (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 399 days.

(21) Appl. No.: 10/564,053

(22) PCT Filed: Jul. 8, 2004

(86) PCT No.: PCT/EP2004/051406

§ 371 (c)(1),
(2), (4) Date: Jan. 10, 2006

(87) PCT Pub. No.: WO2005/007406

PCT Pub. Date: Jan. 27, 2005

(65) Prior Publication Data

US 2006/0185547 A1 Aug. 24, 2006

(30) Foreign Application Priority Data

Jul. 11, 2003 (DE) ..... 103 31 595
Nov. 11, 2003 (DE) ..... 103 52 619

(51) Int. Cl.
*B41F 33/00* (2006.01)

(52) U.S. Cl. ..... 101/484; 101/485; 101/486

(58) Field of Classification Search ..... 101/484, 101/485

See application file for complete search history.

(56) References Cited

U.S. PATENT DOCUMENTS

| | | | | |
|---|---|---|---|---|
| 5,022,950 | A * | 6/1991 | Ingalls et al. | 156/361 |
| 5,395,027 | A | 3/1995 | Erhardt | |
| 5,553,542 | A | 9/1996 | Jackson et al. | |
| H1616 | H * | 12/1996 | Wolfe | 348/88 |
| 5,724,437 | A | 3/1998 | Bucher et al. | |
| 6,021,713 | A | 2/2000 | Glockner et al. | |
| 6,553,908 | B1 | 4/2003 | Richards et al. | |
| 6,779,454 | B2 | 8/2004 | Mengisen et al. | |
| 6,880,458 | B2 | 4/2005 | Munz et al. | |
| 2002/0024681 | A1 | 2/2002 | Leonhardt | |

(Continued)

FOREIGN PATENT DOCUMENTS

DE 85 10 912.6 2/1987

(Continued)

OTHER PUBLICATIONS

Jeff Isherwood, Press Tech Controls, Ltd., "Investitionsentscheidende Kriterien bei der Installation eines Registersteuersystems im Zeitungsdruck,".

*Primary Examiner*—Daniel J Colilla
*Assistant Examiner*—David Banh
(74) *Attorney, Agent, or Firm*—Jones, Tullar & Cooper, P.C.

(57) ABSTRACT

A device is used to influence the fan-on effect of a web in a web-fed rotary printing press. Sensors are used to sense and to monitor a side register control or adjustment of the web. The values provided by the sensor are supplied to the device which controls the fan-out effect.

6 Claims, 5 Drawing Sheets

U.S. PATENT DOCUMENTS

| | | | | |
|---|---|---|---|---|
| 2003/0010235 | A1 * | 1/2003 | Siler | 101/180 |
| 2003/0047092 | A1 | 3/2003 | Dufour et al. | |
| 2004/0163562 | A1 * | 8/2004 | Lewis et al. | 101/485 |

FOREIGN PATENT DOCUMENTS

| | | |
|---|---|---|
| DE | 40 08 282 | 9/1991 |
| DE | 41 30 677 | 3/1993 |
| DE | 43 21 177 | 1/1995 |
| DE | 295 01 373.7 | 6/1995 |
| DE | 199 18 399 | 11/1999 |
| DE | 101 27 249 | 1/2002 |
| EP | 1 048 460 | 11/2000 |
| EP | 1 291 175 | 3/2003 |
| EP | 1 300 243 | 4/2003 |
| EP | 1 403 045 | 3/2004 |
| WO | WO 98/18626 | 10/1997 |

* cited by examiner

METHOD AND DEVICE FOR INFLUENCING THE FAN-OUT EFFECT

CROSS-REFERENCE TO RELATED APPLICATIONS

This patent application is the U.S. national phase, under 35 USC 371, of PCT/EP2004/051406, filed Jul. 8, 2004; published as WO 2005/007406 A2 on Jan. 27, 2005 and claiming priority to DE 103 31 595.0 filed Jul. 11, 2003, and to DE 103 52 619.6, filed Nov. 11, 2003, the disclosures of which are specifically incorporated herein by reference.

FIELD OF THE INVENTION

The present invention is directed to methods and to a device for affecting the fan-out effect of a web. A sensor detects lateral registration over at least a part of the width of the web and controls a device for affecting the fan-out of the web.

BACKGROUND OF THE INVENTION

A system for controlling a web fan-out affect is known from U.S. Pat. No. 6,553,908 B1. At least one, and better yet two, first sensors are spaced apart in the axial web direction. Mechanisms for affecting the fan-out effect are controlled by the sensors, and by the use of measured values from a least a second sensor, mechanisms for controlling the lateral registration are controlled.

A device for correcting the lateral registration of an imprinted material is known from DE 85 10 912 U1. This device has blowing air nozzles situated outside of the transport plane in the end area of a follow-up printing group. A supporting force is applied to the web by charging the nozzles with compressed air in order to deflect them in the desired manner.

DE 195 01 373 U1 discloses a device for the continuous correction of a fan-out effect. In this case, a signal from a sensor, which is arranged in the edge area of the imprinted web, is processed in a control device, and set commands are put out to an appropriate actuating member for the introduction of rollers. In one embodiment, set commands can also be supplied to an actuating member for accomplishing circumferential registration by this control device which is processing the above-mentioned signal. In another embodiment, a circumferential registration takes place, together with a lateral registration regulation, in a separate control device, which is different from the above-mentioned control device, by the use of a separately determined measuring signal.

SUMMARY OF THE INVENTION

The object of the present invention is directed to providing methods and a device for affecting the fan-out effect of a web.

In accordance with the present invention, this object is attained by the provision of a sensor whose images are evaluated, over at least one quarter of the web width, to detect an error in lateral registration. If the error exceeds a nominal value by a pre-set amount, an actuating command is sent to an actuating member to affect web fan-out.

A substantial advantage to be obtained by the use of the present invention consists in that a rapid and a dependable correction of the lateral registration, as well as of the fan-out effect, is possible with the lowest possible outlay.

The integration of the two measuring processes and/or of the controls or algorithms makes possible a correction which fulfills the conditions while reducing the outlay.

BRIEF DESCRIPTION OF THE DRAWINGS

Preferred embodiments of the present invention are represented in the drawings and will be described in greater detail in what follows.

Shown are in:

FIG. 1, a schematic side elevation view of a printing press, in

FIG. 2, a schematic top plan representation of webs of different width, in

FIG. 3, a schematic side elevation view of a printing unit, in

DESCRIPTION OF THE PREFERRED EMBODIMENTS

Figure 1:
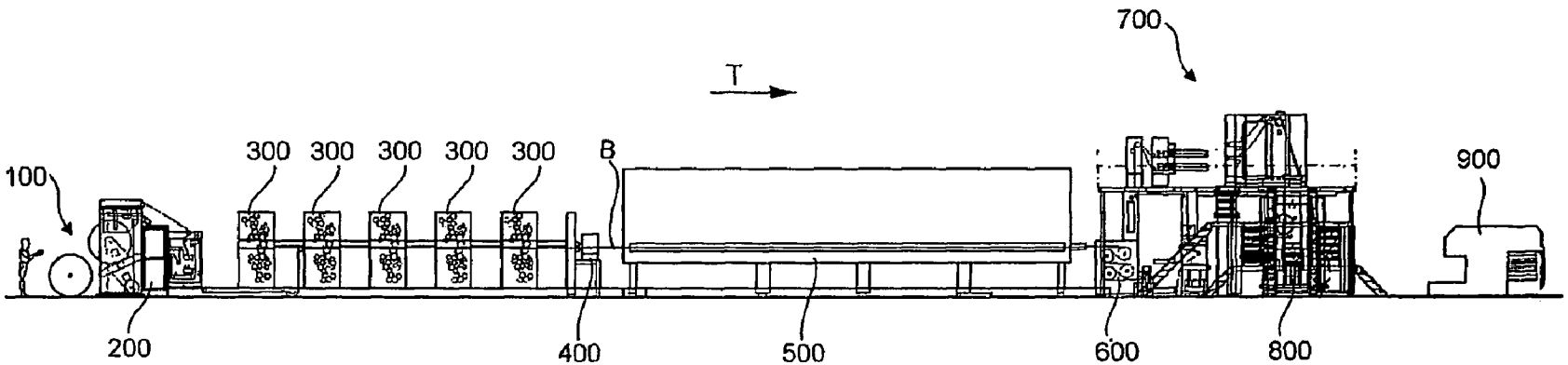

Referring initially to FIG. 1, there may be seen a printing press, and in particular a web-fed rotary printing press for imprinting one or several webs B, and which has several units 100, 200, 300, 400, 500, 600, 700, 800, 900 for provisioning, imprinting and further processing the web or webs. For example, the web B to be imprinted, which, in particular, is a paper web B, is wound off a roll unwinding device 100 before it is supplied via a draw-in unit 200 to one or to several printing units 300. In addition to the printing units 300, which are standardized for multi-color printing for example by using four of them for four-color printing, it is possible to provide further printing units 300, which, in this case, can be utilized in alternation with one or with several of the remaining printing units being out of service for flying printing forme changes.

In an advantageous embodiment, a varnishing unit 400 can be provided in the web path.

Following imprinting and, if required, varnishing, the web B passes through a dryer 500 and is possibly cooled again in a cooling unit 600, if drying is performed thermally. A further conditioning unit such as, for example, a coating device and/or a re-moistening device, which is not specifically represented in FIG. 1, can be provided downstream of the dryer 500 in, or downstream of the cooling unit 600. Following cooling and/or conditioning, the web B can be supplied via a superstructure 700 to a folding apparatus 800. The superstructure 700 has at least one silicon unit, one longitudinal cutter and turning device, as well as a hopper unit, which is also not specifically represented in FIG. 1. The silicon unit can also be arranged upstream of the superstructure 700, for example in the area of the cooling unit 600. Furthermore, the superstructure can have, a perforating unit, a gluing unit, a numbering unit and/or a plow folder, all of which are not represented in FIG. 1. After passage through the superstructure 700, the web B, or partial webs, are conducted into a folding apparatus 800.

In an advantageous embodiment, the printing press also has a separate transverse cutter 900, such as, for example, a so-called piano delivery device 900, in which a web B which, for example, had not been conducted through the folding apparatus 800, is cut into standard sheets and, if desired, is stacked or delivered.

Figure 2:
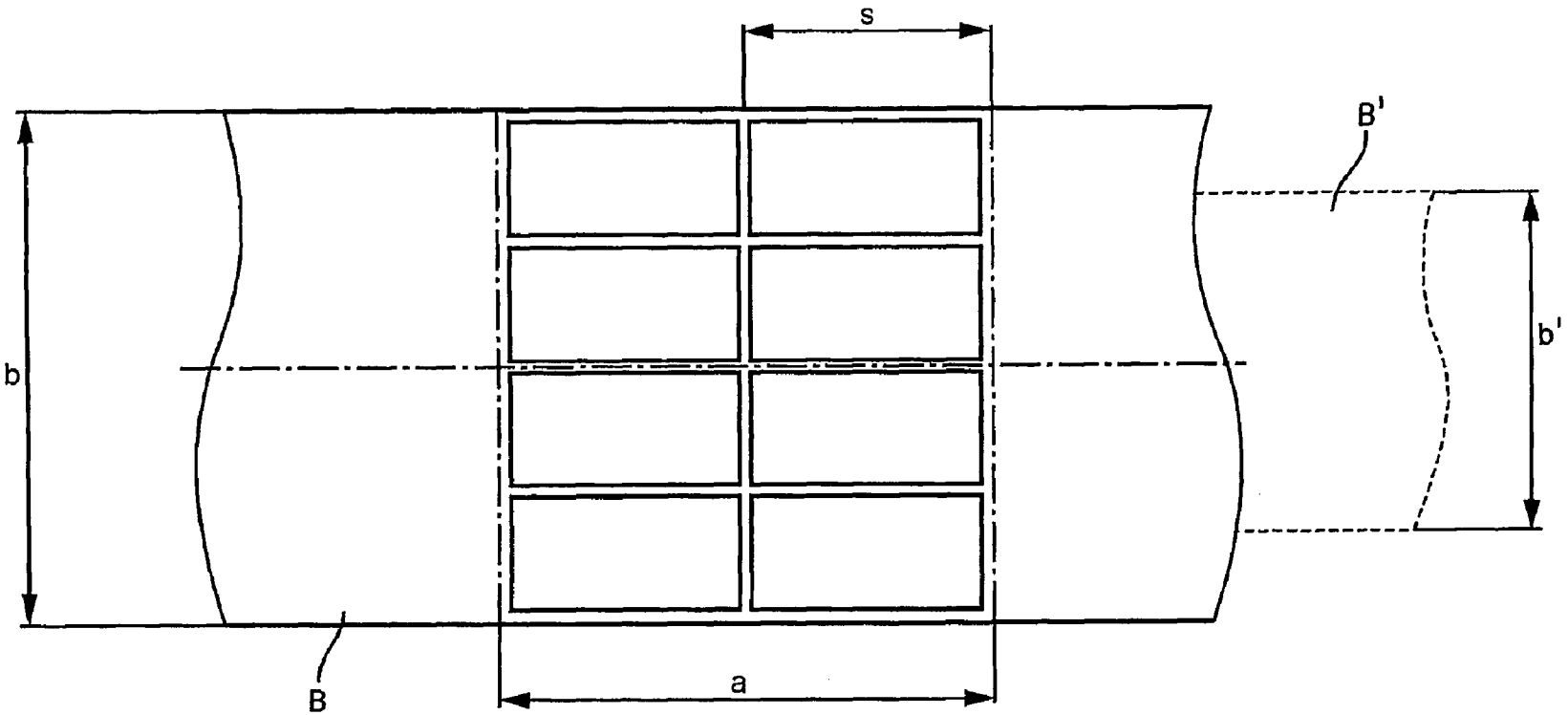

The units 100, 200, 300, 400, 500, 600, 700, 800, 900 of the printing press have an effective width transversely, in respect to a transport direction T of the web B, which effective width permits processing of webs B of a maximum width "b," or web width "b", as seen in FIG. 2 of, for example, up to 1,000 mm. The effective width is understood to be the respective width, or the clear width, of the structural components, such as, for example, the width of the rollers, cylinders, passages, sensor devices, actuating paths, etc. of the units 100, 200, 300, 400, 500, 600, 700, 800, 900, which work together with the web B, either directly or indirectly, so that the web B can be processed, conditioned and conveyed in its full width "b." The functionality, such as material supply, web transportation, sensor devices, further processing devices of the units 100, 200, 300, 400, 500, 600, 700, 800, 900 is configured in such a way that webs B' of only partial width down to a width "b'" of only 400 mm can be processed in the printing press.

The units 100, 200, 300, 400, 500, 600, 700, 800, 900 which define, or process, a section length "a"of web B are configured in such a way that they define, for example, a section "a"of a length of between 540 and 700 mm on the web B. The section length "a"advantageously lies between 540 and 630 mm. In a special embodiment of the invention, the section length "a"lies at 620 ±10 mm. In a further development of the printing press the units 100, 200, 300., 400, 500, 600, 700, 800, 900 are configured in such a way that, with a few changes, the printing press can be selectively configured with section lengths of 546 mm, 578 mm or 620 mm. Thus, for example, substantially only an exchange capability of bearing elements for printing group cylinders, a matching of the drive mechanism , as well as matching in the folding apparatus 800 or the transverse cutter 900, all as discussed subsequently, are required for accomplishing the change in order to equip the same printing press for formats which differ from each other. For example, in a standard way, the section length "a"is covered by four vertical printed pages, for example DIN A4, positioned side-by-side in the transverse direction of the web B, and two printed pages, for example of a length "s"one behind the other in the longitudinal direction. However, depending on the print image and on the subsequent further processing in the superstructure 700 and in the folding apparatus 800, other numbers of pages per section length "s"are also possible.

Figure 3:
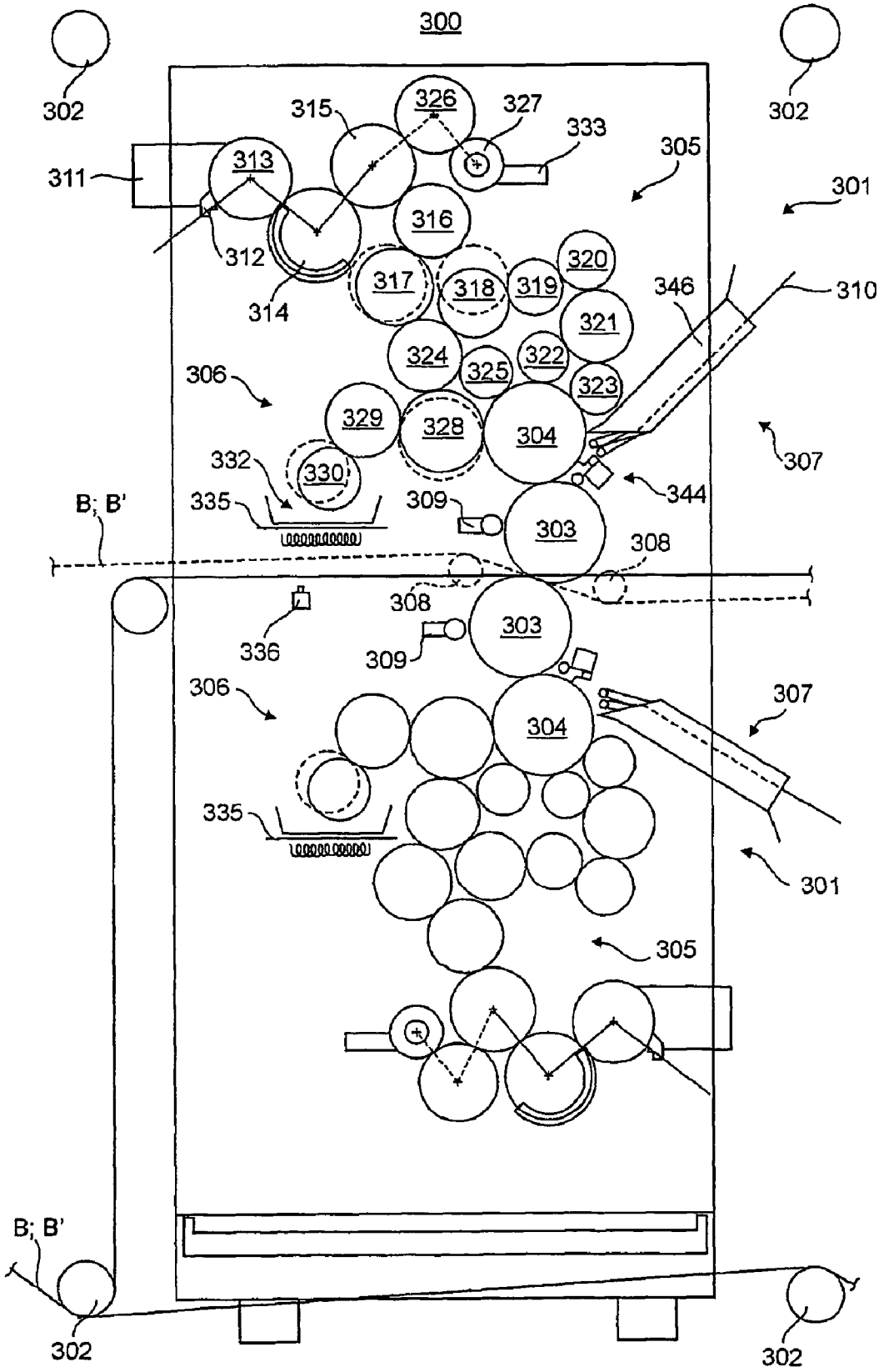

For multi-color imprinting of the web B, B', the printing press has several, such as, for example, at least four, and here in particular five identically equipped printing units 300. The printing units 300 are preferably arranged one next to the other, and a web B, B' passes horizontally through them, as seen in FIG. 1. Each printing unit 300 is preferably configured as a printing unit for offset printing, and in particular is configured as a double printing group 300, or as an I-printing group 300, with two printing groups 301, such as, for example, two offset printing groups 301, as seen in FIG. 3, for accomplishing two-sided printing by the so-called rubber-against-rubber process. Rollers 302 are arranged upstream and downstream at least in the lower area, and optionally in the upper area, of at least one of the printing units 300, by the use of which roller 302 an incoming web B, B' can be conducted around above or below the printing unit 300, or a web B, B', which has been conducted around an upstream located printing unit 300, can be passed through the printing unit 300, or a web B, B' which has been passed through the printing unit 300 can be conducted around the downstream located printing unit 300.

FIG. 3 schematically shows an arrangement of two printing groups 301 which are working together via the web B, B', each with a pair of printing cylinders 303, 304 embodied as a transfer cylinder 303 and as a forme cylinder 304, an inking system 305 and a dampening system 306. In an advantageous embodiment, at the forme cylinder 304, the printing unit 300 has devices 307 for semi- or for fully-automatic plate feeding, or for changing of a printing forme 310, for example a printing plate 310.

In a further embodiment, in particular if the printing press is intended to be suitable for imprinting operations, at least one or several of the printing units 300 have additional guide elements situated closely ahead of, and closely behind the nip point of the printing unit 300. If a web B, B'is to pass without being imprinted and without contact between the transfer cylinders 303, the web guidance, accomplished with the use of the guide elements 308, shown in dashed lines in F*ig*. 3, is advantageous. The web B, B'passes through the nip point in such a way that it substantially forms an angle of between 80° and 100° , and preferably of approximately 90° with a connecting line joining the axes of rotation of the two transfer cylinders 303. Preferably, the guide elements 308 are provided as rods or as rollers, around which air flows. This reduces the danger of previously freshly applied ink rubbing off.

In a further development of the represented printing group 301, a washing device 309 is assigned to each transfer cylinder 303. The elastic surface of the transfer cylinder 303 can be cleaned by use of the washing device 309.

Each of the cylinders 303, 304 has a circumference between 540 and 700 mm. The forme and the transfer cylinder 303, 304 preferably have the same circumference. In an advantageous manner, the circumferences lie between 540 and 630 mm. In a special embodiment, the section length "a" lies at 620±10 mm. In a further development, the printing unit 300 is structured in such a way that, with a few changes, the cylinders 303, 304 can be provided designed with circumferences of 546 mm, 578 mm or 620 mm. Thus, for example, substantially only an exchange of bearing elements or a changed position of the bores in the lateral frame, and the lug for the cylinders 303, 304, and a matching of the drive mechanism or lever takes place, as discussed subsequently.

The transfer cylinder 303 has a least one dressing on its circumference, which is not specifically represented, and which is held in at least one groove extending axially on the transfer cylinder shell face. Preferably, the transfer cylinder 303 only has one dressing extending over its effective length, or substantially over the entire width of the web B, B' to be imprinted, and substantially extending, except for a joint or a groove opening around the entire circumference of the transfer cylinder 303. Preferably the dressing is configured as a so-called metal printing blanket, which has an elastic layer, such as for example, of rubber on a substantially dimensionally stable support layer, for example a thin metal plate. The ends of this dressing are inserted through an opening in the shell face of the transfer cylinder 303 into the groove and are held there by frictional or by positive contact. In the case of a metal printing blanket, the ends are bent/beveled off, for example, in the area of its leading end by approximately 45°, and in the area of its trailing end by approximately 135°. These ends extend through an opening of a groove extending over the entire usable length of the transfer cylinder 303, which groove also has, for example, an arresting, clamping or tensioning device. The opening to the groove, in the area of the shell face, preferably has a width between 1 and 5 mm, and in particular, has a width of less than or equal to 3 mm, in the circumferential direction of the cylinder 303. The clamping device is advantageously embodied to be pneumatically operable, and may be for example, in the form of one or of several pneumatically operable levers, which levers, in the closed state, are pre-tensed by a spring force against the trailing end extending into the groove. A hose, which can be charged with a pressure medium, can preferably be employed as an operating device.

In addition to an ink feeding device, such as, for example, an ink fountain 311 with an actuating device 312, for use in regulating the ink flow, the inking system 305 has a plurality of rollers 313 to 325. The ink feeding device can also be configured as a doctor blade crosspiece. With the rollers 313 to 325 placed against each other, the ink moves from the ink fountain 311 via the duct roller 313, the film roller 314, and a first inking roller 315, to a first distribution roller 316. Depending on the mode of operation of the inking system 305, as will be discussed below, from there, the ink moves via at least one inking roller 317 to 320 to at least one further distribution cylinder 321, 324, and from there, via at least one application roller 322, 323, 325, to the surface of the forme cylinder 304. In an advantageous embodiment, the ink moves from the first distribution cylinder 316 over several possible paths selectively or simultaneously either in series or in parallel, via two further distribution cylinders 321, 324 to the application rollers 322, 323, 325. In an advantageous embodiment of the inking and dampening system 305, 306, the second distribution cylinder 324 can work together with a roller 328, such as, for example, with an application roller 328, of the dampening system 306 at the same time.

The roller 328 works together with a further roller 329 of the dampening system 306, such as, for example, a distribution roller 329, and in particular, a traversing chromium roller 329. The chromium roller 329 receives the dampening agent from a moistening arrangement, such as, for example, a roller 330, and in particular a dipping roller 330, which roller 330 dips into a dampening agent supply 332, such as, for example, a water fountain. A drip pan 335 is preferably arranged underneath the water fountain for use in catching condensation water forming on the water fountain which drip pan, in an advantageous embodiment, is configured to be heatable, for example by the use of a heating coil.

In a further development, the inking system 305 has, in addition to the rollers 313 to 325, at least one further roller 326, by the use of which roller 326 ink can be removed from the inking system 305, in particular upstream of the first distribution cylinder 316. This takes place in that this roller 326 itself or, as represented, a roller 327 working together with it, can be placed against an appropriate removal device 333, all as seen in FIG. 3.

The printing unit 300, and in particular, a second and/or third and/or fourth and/or possibly fifth printing unit 300, which is or are following the first printing unit 300, has in its inlet area, or in the area of its inlet nip between the two transfer cylinders 303 a device 336 for affecting the fan-out effect, i.e. for affecting a change in the transverse extension or width of the web B, B', as that web travels from one print location to the other, which fan-out effect is caused by the printing process, and in particular is caused by moisture. The device 336 is preferably arranged in the inlet area of a printing unit 300 which is following the first printing unit 300, i.e. in an area where the web has been imprinted at least once. It has at least an actuating member 338, as seen in FIG. 4, which may be, for example, a support element 338, by the use of which, either with a contact of the web B, B', or advantageously without a web contact, the latter can be deflected in a direction perpendicularly to the web plane.

Figure 4:
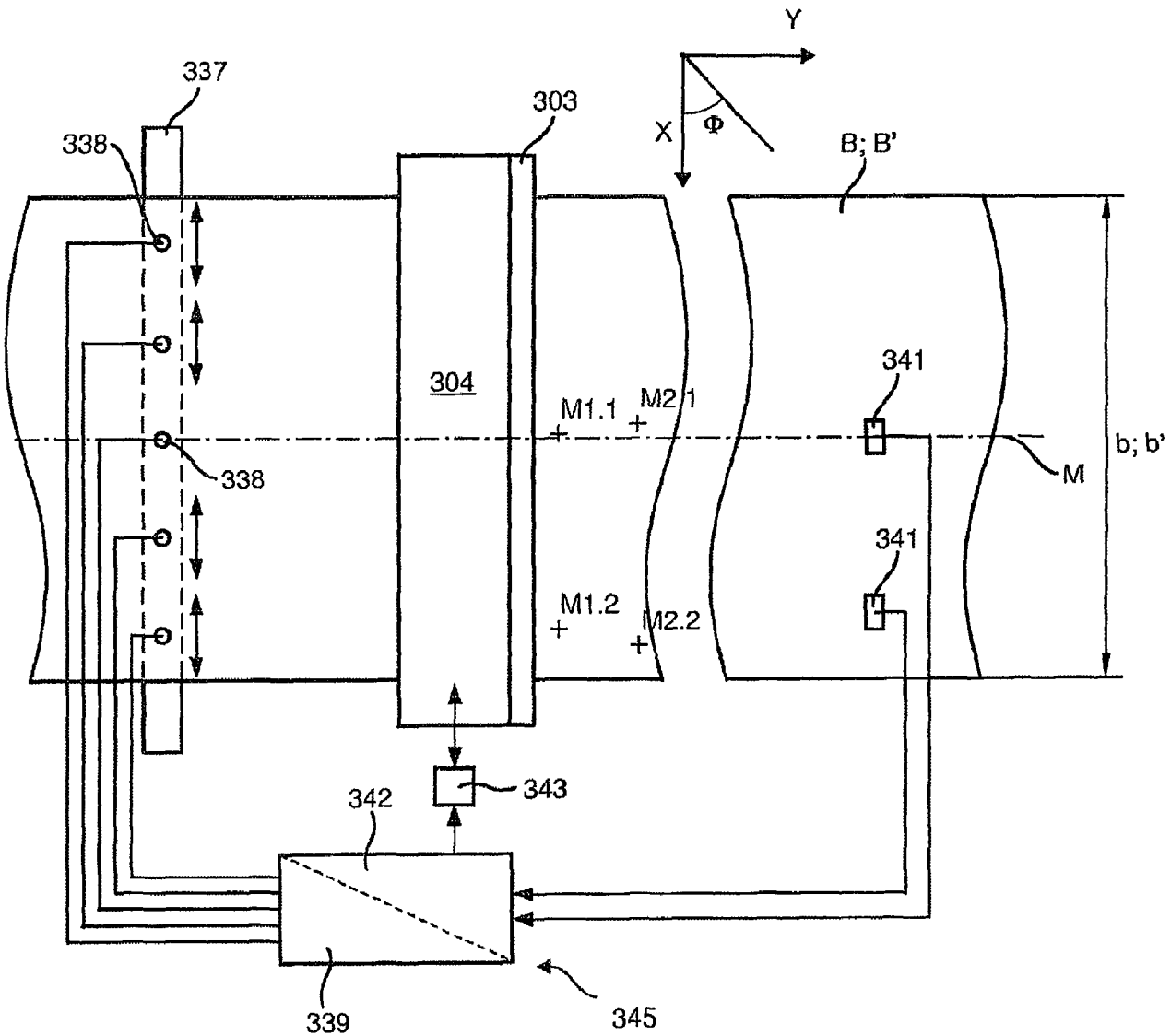
FIG. 4, a schematic top plan view of a first preferred embodiment of a device in accordance with the present invention for affecting the fan-out effect, and in FIG. 5, a schematic top plan view of a second or a third preferred embodiment of a device for affecting the fan-out effect.

To this end, at least one support element 338, which is embodied as a nozzle 338, is arranged on a cross-beam 337, as seen in FIG. 4 in such a way that gas, and in particular air, flowing out of nozzle 338 is directed onto the web B. B'. Depending on the force of the flow, the web B, B' when it is passing through this area, undulates more or less, or is deflected out of a substantially level cross section, which undulation or deflection results in a correction of the width "b," "b'" and of the lateral alignment of each partial area of the printed image. Advantageously, at least five, and in particular seven nozzles 338 are, for example, arranged axially side-by-side across the width of the web. If desired, support elements, such as the nozzles 338, which are offset with respect to each other can also be arranged on both sides of the web B, B', which support elements 338 engage each other in the manner of teeth over the web and deform the web B, B' in an undulating manner. The force of the air flow, such as, for example, for each nozzle 338, is preferably set by the use of non-represented servo valves. In the course of this, it is possible to assign a pressure from 0 to a maximum value to each nozzle 338, for example manually, via a control device or a regulating device. It is also possible to basically assign the same value of pressure to all of the nozzles 338, but to set the type and strength of the correction, such as, for example, the waviness or the deflection, at the opened nozzles 338 by the specific selection of a partial amount or number, less than or equal to the total number of the nozzles 338.

In an advantageous embodiment of the present invention, the nozzles 338, or at least the nozzles 338 which are located the farthest outward on the cross beam 337, or all of the nozzles 338, except those located in the center of the cross beam 337, are arranged, so as to be adjustable in the axial direction, on the cross beam 337. The adjustability can take place by the use of techniques for manual setting, such as loosening and displacing, manually operable spindles, or by the use of drive mechanisms, such as, for example, motors. The latter is particularly advantageous if the axial positioning, or at least its pre-setting, is performed automatically by the machine control device on the basis of the intended width b, b' for imprinting the web B, B'.

The device 336 for affecting the web fan-out effect receives its setting commands from a control device 339, which control device 339, in turn, receives measured values for the lateral position of markers that are sequentially imprinted by the various printing groups, typically with different colors, with partial printed image portions, or with partial printed images, from at least one downstream arranged sensor 341. It is intended, in the discussion that follows, to understand the term partial printed image, or partial printed image portion, to mean one of several sequentially applied colors of the same printed image or of the same partial printed image, which is often called a "color separation,"of one of the colors to be printed. A printed image composed of, for example, four ink colors, has four color separations, i.e. four partial printed images of the colors to be applied on top of each other.

Two markers M1.1, M1.2, are applied by a first printing unit 300.1, and which are spaced apart from each other in the axial direction. Two other markers M2.1, M2.2, which are applied by a second printing unit 300.2, are all represented, byway of example, in FIG. 4. In a correct setting of the press, the markers identified by M×.1, and the markers identified by M×.2 are each intended to lie in the same alignment to each other, i.e. wherein an axial distance is zero or, in another embodiment, are intended to lie at least at an axially fixedly predetermined finite distance, or predetermined value from each other. Preferably, a number of marker pairs, M×. 1, M×.2, which number of marker pairs corresponds to the number of printing units 300 imprinting the web B, B', has been applied.

A series of one marker M1, M2 applied by each printing unit 300, respectively, in a first embodiment, or a series of definite image points or image areas of partial printed images, in a second embodiment, is sufficient for merely determining the lateral registration, in the coordinate cross in FIG. 4 a relative position of the markers following each other, as viewed in the x direction. For lateral registration regulation or correction, preferably only the relative axial position of these sequentially imprinted markers M1, M2, etc., or similar image points, with respect to each other, is checked. In case of a deviation from a relative nominal position, such as, for example, a spacing distance of zero, the printing groups, or the forme cylinders 304 carrying the printed image, are aligned, with respect to each other, until the nominal position is correct and the partial printed images assume the required position with respect to each other in the axial direction. In this case a nominal position, or reference is preferably defined by the use of the position of one of the imprinted markers M1, M2, etc. as the reference marker. In particular, in case of a combination with the fan-out regulation to be described below, advantageously the position of the first applied marker M1 from the first printing unit 300, and the remaining printing units 300, or markers M2, etc. are oriented in accordance with that. This means that the regulation of the partial printed images preferably takes place here in relation to each other, and not absolutely, with respect to the measurement location, or to the stationary sensor 341. In principle, the same method can be applied to the definition of the nominal position of a partial printed image portion, or of a partial printed image, wherein, for example, the first partial images, or defined image points of the first partial image are used as reference, and the remaining partial printed images, or image points of the remaining partial printed images are aligned with respect to that first partial image or defined image points of the first partial printed image. Relative nominal positions of the remaining partial printed images for use as a reference can be obtained, for example, from recorded measurement data of a previous print that is considered to be good, or advantageously can directly be the image data of the print pre-stage.

Figure 5:
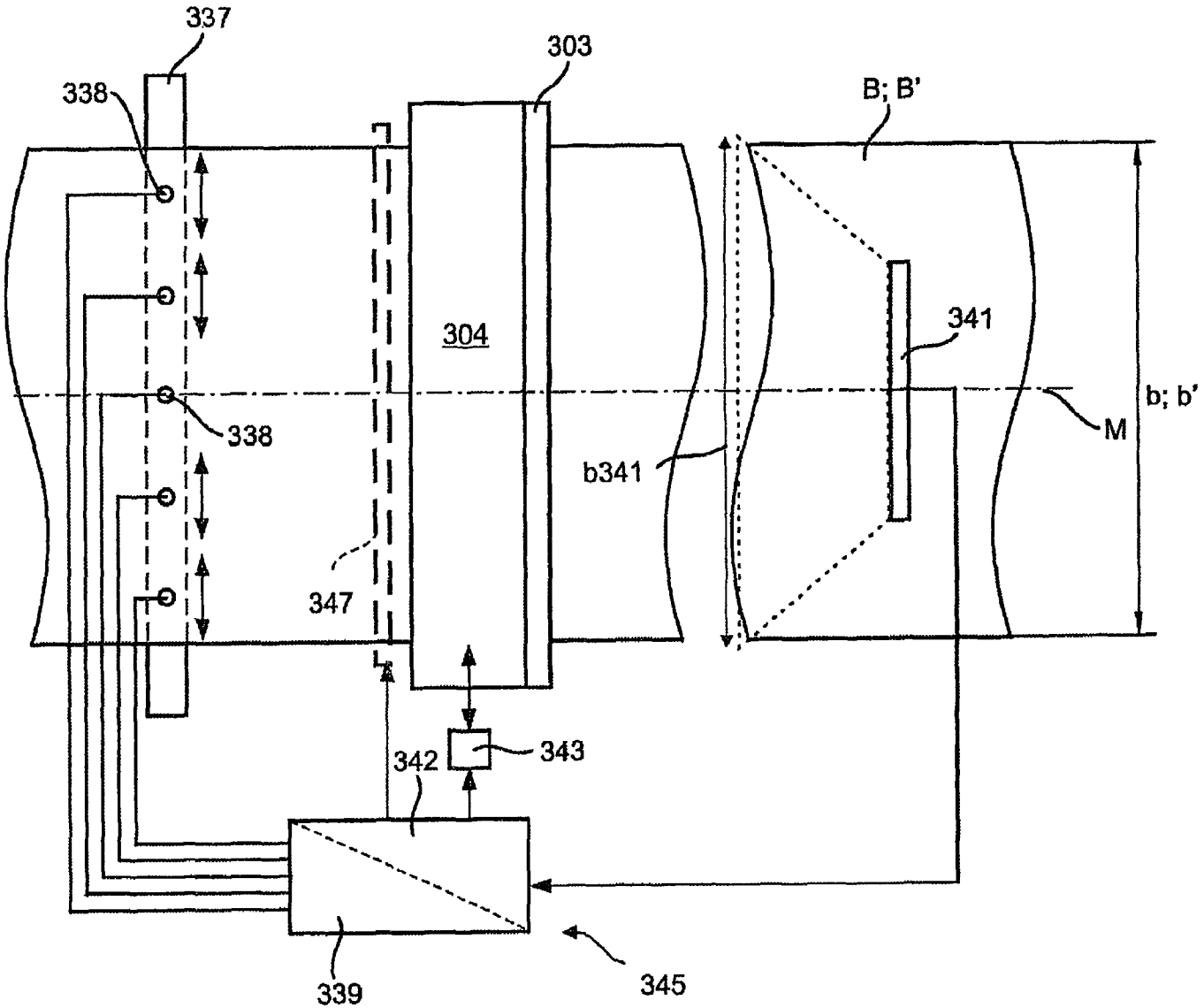

In the embodiment, which is represented in FIGS. 4 and 5, and which depicts an economical device in accordance with the present invention, no separate sensors for use in detecting the printed image, are arranged for use exclusively by the device 336 for affecting the fan-out effect. However, use is made of the measured values from a lateral registration control/regulation device 342. This means that the lateral registration/regulation device 342 and the device for affecting the fan-out effect 336 both make use of the measured value of at least one common sensor 341. The lateral registration control/regulation device 342 aligns the respective partial printed image, in one color as a whole in its axial position. To this end the forme cylinder 304, or the printing forme 310, which is located on the cylinder 304, is appropriately moved in an axial direction with respect to the web B, B', such as, for example, by the use of an actuating member or an actuating element 343. The sensor arrangement and, if required, portions of the lateral registration control/regulation device 342, are employed for triggering the device 336 for affecting the fan-out effect, or vice versa.

So that, in a parallel manner, the sensor arrangement 341 of the lateral registration control/regulation device 342 is also usable with the device 336 for affecting the fan-out effect, in an advantageous first embodiment, as seen in FIG. 4 the sensor arrangement 341 has at least two measuring points, or two sensors 341, which two sensors 341 are arranged side-by-side in the, axial direction of the cylinders, and which each detect, respectively, one partial printed image portion that is located on the web B, B', or detect the above-mentioned imprinted markers Ml .1, Ml .2, M2.1, M2.2. The sensors 341 can be embodied as image sensors, such as, for example, as reading heads and which are provided with the appropriate evaluation software of a system for color registration regulation. If the partial printed image, as a whole, differs, in a lateral direction, from its nominal position or its reference marker or reference image point, a correction takes place at the printing group and specifically at the forme cylinder 304, which is causing the deviation, via the actuating device 343 for lateral registration. If the evaluation of the measurement, such as by use of markers M1.1, M1.2, M2.1, M2.2, or partial image points shows that, although the partial printed image has assumed the correct axial position, there is a distortion or a widening of the partial printed image, in comparison to the reference, correction takes place via the device 338 for affecting the fan-out effect. In the case of mixed effects, both corrections take place, of course, wherein a cycle of first correcting the lateral registration and then correcting the distortion is of advantage.

By the use of the markers from two of the printing units 300, which are represented by way of example, an evaluation is explained, again by way of example, in what follows. The markers M1.1, M1.2 should be defined here as reference markers and, for the sake of simplicity, the required axial distance of the following markers M2.1, M2.2 of a series should equal zero, so that markers M2.1, M2.2 should be aligned with the reference markers M1.1, M1.2. Preferably, the imprinted markers M1.1 and M1.2, which preferably are viewed axially, are located in a center imprinted area which, assuming a correct web run, also corresponds approximately to the area of the web center M. The imprinted markers M1.1 and M1.2 can also be situated at a distance from the center of the printing area or the web area, as known from the locations of the printing formes. In the arrangement represented in FIG. 4, the evaluation of the four markers M1.1, M1.2, at M2.1, M2.2 shows a deviation of the second partial printed image in the lateral registration which deviation, in this case, substantially corresponds to a deviation in the axial distance between the two center markers M1.1 and M2.1, and to a deviation in the term of a fan-out, which substantially corresponds to the distance between the outer markers M1.2 and M2.2, less a possibly existing lateral registration error. In the present case, the lateral registration error must be added to this distance between the outer markers, or, a lateral registration error, with a negative operational sign, must be subtracted, since, in this case, the lateral registration error and the fan-out error have effects on the two different sides of the web B, B'.

Therefore, in an advantageous embodiment of the first preferred embodiment, one of the sensors 341, and the associated markers M1.1, M2.1, are arranged substantially centered with respect to the running web B, B', or with respect to the full imprinted image width, and the other one of the sensors 341 is arranged in an area close to the edge. In this way, it is possible to make a quick statement, independent of the fan-out effect, regarding the lateral registration, and to achieve, at the same time, the largest possible resolution, in the course of determining the fan-out effect.

If the sensor 341 for use in detecting the lateral registration, is not always arranged centered in respect to the web B, B', this combined procedure is advantageous to the extent that a statement regarding an error in the lateral registration can only be made after having knowledge of the extent of fan-out. By the use of a simultaneous, or of parallel, processing, it is possible to avoid an erroneous interpretation of a signal which is employed by the lateral registration control/regulation device 342, for example. Thus, knowing at least one of the two measurement locations or image points, as discussed below, an extrapolation towards the web center is possible, from which extrapolation, the size of the lateral registration error can be derived, as a rule.

Therefore, the control device 339 and the lateral registration control/regulation device 342 can be modules of a common program, for example, whose steps are sequentially and, if required, are also cyclically, performed, wherein a common algorithm, for example, is assigned to the interpretation of the measured values and to subsequent error correction.

The control device 339 and the lateral registration control/regulation device 342 can also be embodied as two calculation algorithms which are separate from each other, but which preferably are coupled to each other.

It is possible, in these cases, to provide one unit, in accordance with existing software or hardware technology, and which is here identified as control device 345, for both matters.

However, the control device 339 for use in affecting the lateral registration, and the lateral registration control/regulation device 342 can also be embodied as two, structurally separated hardware units. For example, this arrangement is advantageous when retrofitting existing arrangements, or when making use of finished accessories wherein, however, preferably a signal connection, at least for transmitting the lateral registration error to the lateral registration control/regulation device 342, should be provided.

In an advantageous further development, in accordance with the present invention, the markers Ml .1, Ml .2, M2.1, M2.2, or at least a series of markers Ml .1, M2.1, and/or M1.2, M2.2 of successive printing units 300, are evaluated regarding their position, or regarding a spacing in the transport direction, with respect to each other, or with respect to a reference marker, in order to correct the circumferential registration, or the color registration of the partial printed images in relation to each other, such as shown in the coordinate cross in FIG. 4, a relative position of the markers following each other, as viewed in the y direction. If a deviation of one or of several of the partial printed images exists, the circumferential registration is corrected. The respective printing group, or its forme cylinder 304, is rotated, in relation to its angular position in respect to the other or to the reference printing group by a non-represented actuating device, or by an individual drive mechanism. This evaluation, and respective triggering, if required, can also be performed from the control device 345.

In a further development in accordance with the present invention, the positions or the distances between successive markers M1.1, M2.1 and M1.2, M2.2 of both series are evaluated regarding their position, or their distances, relative to each other, in the transport direction, or relative to a reference marker. If, when viewed in the transport direction, or the direction, y of the web B, B', an error in the distance between the markers M1.1, M2.1 of the one series deviates from an error in the corresponding distance between the markers M1.2, M2.2 of the other series, an angular error in one of the partial printed images, such as may be, for example, caused by an exposure error when producing the printing forme, or by its erroneous placement on a cylinder, can be deduced. The respective partial printed image then is rotated by an angle $\phi$ with respect to the other partial printed image. This error is then counteracted by placing at least one of the forme cylinders into an oblique position, which is called the setting of an oblique registration, or cocking.

For example, the fan-out effect, together with the lateral registration, taken in the x direction, and/or the circumferential registration, taken in the y direction and/or the oblique registration, are thus monitored and are evaluated by the use of the sensors 341 and/or by the use of the control device 345.

In a second preferred embodiment of the present invention, as depicted in FIG. 5, a single sensor 341, which detects the printed image, at least over a scanning width b341, is arranged in place of the two sensors 341 shown in FIG. 4, which two sensors 341 point by point detect the two series of markers, whereas the scanning width b341 covers at least the position of the two series of markers. In the course of evaluating the recorded image from the sensor 341 which sensor 341 is, for example, embodied as a line camera or as a planar camera, as discussed below, a recognition of the markers M1.1, M1.2, M2.1, M2.2, which are printed in different colors, and which are, for example, configured in the form of crosses, initially takes place by the use of appropriate image processing software. Subsequently, an evaluation in the manner as described in connection with the first preferred embodiment is conducted.

In a third preferred embodiment, a sensor 341, which detects the printed image of each of the partial printed images, which are of different colors, at least over a scanning width b341 extending significantly in the axial direction, is arranged in place of the two sensors 341, which are used for detecting the printed image and/or the markers in a point by point manner. Significant scanning width in this context means a width which allows the detection of two image points of a partial printed image, of one color, which are sufficiently axially spaced-apart from each other by use of the observed portion. These image points advantageously should lie sufficiently far apart from each other so that a change in the relative axial distance of the two image points, which are spaced apart from each other, can be detected with the required resolution. Two partial printed areas, which are axially spaced apart from each other, or two image points, or two image point groups of the same partial printed image now take the place of the two markers M1.x, M2.x of the same partial printed image. Again, corresponding to what had been said above, the partial printed images are brought into congruence as best as possible in that the lateral registration, the fan-out, the circumferential registration and/or the oblique registration are evaluated by the use of the image which is detected by the sensor 341, and are corrected. Here, imprinted markers M1.1, M2.1, which are defined as reference markers, are not used as references. Instead, data defining preset nominal values are stored, preferably for each of the partial images or colors. In this connection, in one embodiment, as has already been indicated above, defined image points of the first partial imprinted image can be used as reference, and the remaining partial printed images, or image points of the partial printed images, can be aligned using this reference. Relative nominal positions, with regard to this reference, of the remaining partial printed image, or of their image points can, for example, be obtained from the recorded measured data of a print which is considered to be good, or advantageously can be obtained directly from image data of the printing pre-stage. In another embodiment, the relative positions of the relevant reference points, or image points of all of the partial printed images, printed in the various colors with respect to each other are obtained via the printing pre-stage and are stored as relative nominal positions, with respect to each other.

Since the effects of the relative lateral displacement, or fan-out of the image points grows with increasing web width b, b', the minimum scanning width b341 in the second and third preferred embodiments, taking into account the resolution of appropriate cameras and the expected quality of the printed image, should be at least a quarter of the maximum web width b which is to be processed in the printing press. In an improved embodiment of the present invention, the scanning width b341 is at least half of this web width b and covers the printed image of the entire web half, starting at the web center M. In this variation, the fan-out effect, which as a rule, is formed approximately symmetrically, on each one half of the web, can be accurately determined and suitable countermeasures, such as by the individual, profiled triggering of nozzles, rollers, and the like can be determined and can be introduced, in a manner which is matched to the detected fan-out. Advantageously, the entire scanning width b341 is evaluated with respect to the expansion change or fan-out. Here, the width of the sensor 341 is not to be understood as the scanning width b341, which scanning width b341 is the width of its field of coverage on the web B, B', which scanning width b341 is schematically indicated in FIG. 5 by dashed, diverging lines.

Preferably, in the second and third preferred embodiments an image sensor 341, such as, for example, a color camera 341, and in particular a digital semiconductor camera 341, with at least one CCD chip, can be arranged, as the sensor 341, at the outlet of the printing unit 300 of the printing press, which is the last one in the transport direction of the web B, B'. The image-recording area of the sensor 341 can preferably be aimed immediately and directly on the web B, B', wherein the image-recording area of the image sensor 341 advantageously has at least the entire web width b, b' as the scanning width b341, in the transverse direction. Thus, the image sensor 341 picks up an image, which can be electronically evaluated, of the entire width b, b' of the imprinted web B, B'. The image sensor 341 is, for example, configured as a planar camera 341. The recorded image is then evaluated, with regard to lateral registration, as well as to fan-out, and, if required, is also evaluated with regard to circumferential registration and/or to oblique registration, in an electronic evaluating device of the image sensor 341 itself and/or in the control device 345 having the fan-out control device 339 and/or the lateral registration control/regulation device 342. Subsequently, actuation orders, if required, are issued to the respective actuating devices 338, 343. The two image sensors 341 of the first preferred embodiment of the present invention can each be embodied as image sensors 341 having, in particular, a CCD chip.

In a further development of the present invention, in the case of the embodiment of the sensor 341 as a sensor 341, which is detecting the print image over the entire width b of the web B, other parameters, which are relevant to the printing process, can also be controlled, or evaluated by an appropriate evaluation unit and, in case this may be required, can also be controlled automatically, so to speak, by the use of programs which are running in the evaluating unit. The evaluation and the correction of several parameters, which are relevant to the printing process, can take place in an essentially parallel manner by the same evaluating unit, such as, for example, the control unit 345. It is possible, in a particularly advantageous manner, to evaluate the printed image, which was recorded by the image sensor 341, in the course of a production run of the printing press, and which was forwarded, in the form of a mass of data, to the appropriate evaluating unit, to determine whether the print image, which was actually recorded in the image and which was evaluated, has a change in the tone value in comparison with a previously recorded and evaluated printed image, or in comparison with a stored reference, such as, for example, an actually recorded image which is checked during a running process, in comparison with a reference image. If the result of the check is a change in the tone value, it is possible, in a manner which is only schematically symbolized by an actuating member 347, to change the color density, or the metering and/or the supply of ink to the printing press, in one or in several of the printing groups 304 by appropriate actuating commands for setting of the color metering devices, setting a roller or setting an ink temperature.

In the second and third preferred embodiments, the employment of a line camera, which is provided with permanent illumination, is also possible as an alternative to the preferred planar camera. The line camera can be provided, in particular, with a flash lamp.

In place of the nozzles 338, it is also possible, in principle, to arrange rollers, which are not specifically represented, and which touch the web B, B' or, in a particularly advantageous manner, to provide support elements 338 which guide the web B, B' in a contactless manner, and which have, on their side facing the web B, B', micro-openings through which compressed air flows. In contrast to the depicted nozzles 338, the micro-openings in the support elements do not form a sharp air flow, but instead form an air cushion interposed between the surface of the support elements 338 and the web B, B'. In this case the control device 339 acts on actuating drives, which are not specifically shown, and which move the support elements 338 in a direction perpendicularly in respect to the web plane. The micro-openings can have a diameter of less than 500 μm, and advantageously of less than or equal to 300 μm, and in particular less of than or equal to 150 μm. In one embodiment, these micro-openings can be open pores of a porous material that is constituting the effective surface on the support element 338, and in particular can be a sinter material with pores of a mean diameter or mean size of less than 150 μm, such as, for example, of 5 to 60 μm, and in particular of 10 to 30 μm. In another embodiment, these micro-openings represent the outward directed openings of micro-bores of a diameter of less than or equal to 300 μm, and in particular of between 60 and 150 μm.

As indicated in FIG. 3 and as already mentioned above, in an advantageous embodiment, the printing group 301 includes the device 307 for accomplishing the, at least semi-automatic, changing of a printing forme 310 on the assigned forme cylinder 304. The plate changing device 307 is configured in two parts and has a contact pressure device 344, also called a "semi-automatic changer" 344, which is arranged in the area of a nip point between the forme and transfer cylinders 303, 304, and a magazine 346, that is structurally separated from it, and that is provided with feeding and receiving devices for the printing formes 310.

While preferred embodiments of methods and a device for influencing the fan-out effect of a web in accordance with the present invention, have been set forth fully and completely hereinabove, it will be apparent to one of skill in the art that changes in, for example, the specific structure of the printing units, the type of webs being printed, and the like could be made without departing from the true scope and spirit of the present invention which is accordingly to be limited only by the appended claims.

What is claimed is:

1. A method for affecting a fan-out effect on a printed image on a web including:

providing a web having a web width;

providing an image on said web;

providing first and second image points of two image portions of a color separation of a defined color of said printed image;

locating said first printed image point at a first location with respect to said web width and locating said second printed image point at a second location with respect to said web width, said first and second locations being spaced from each other laterally on said web width;

providing a sensor;

using said sensor for determining said first and second locations of said first and second printed image points of said two printed image portions of said color separation of said printed image;

providing reference image data of said first and second image points of said two printed image portions of said color separation of said defined color of said printed image from a print pre-stage;

using said print pre-stage image data for determining reference locations of said first and second image points;

comparing locations of said printed images of said first and second image points, in respect to their axial positions on said web with said reference locations of said first and second image points;

determining lateral deviations of said first and second image points of said printed image from said reference locations of said first and second image points resulting from at least one of an increase in said web width caused by said fan-out effect of said web and a registration error occurring during said printing of said image on said web;

extrapolating said lateral deviations of said first and second image points of said printed image for a plurality of image points of said printed image portions of a color separation of said defined color of said printed image;

providing an actuating member for affecting said fan-out effect;

sending an actuating command to said actuating member when said lateral deviations of said printed image points exceeds a preset nominal value; and using said actuating member for affecting said fan-out of said web.

2. The method of claim 1 further including providing a scanning width including a center of said web and determining said lateral registration error of said image area from its nominal position with respect to said center of said web.

3. The method of claim 1 further including using said sensor for detecting said image points of said printed image over at least one half of said web width.

4. The method of claim 3 further including using said sensor for detecting said image points of said printed image over a whole width of said web.

5. The method of claim 1 further including providing said sensor as a line camera.

6. The method of claim 1 further including providing said sensor as a planar sensor.

* * * * *